US005135213A

United States Patent [19]

Malachowski et al.

[11] Patent Number: 5,135,213

[45] Date of Patent: Aug. 4, 1992

[54] APPARATUS FOR METHOD FOR HIGH SPEED SHEET FEEDING

[75] Inventors: Michael A. Malachowski; David R. Kamprath, both of Webster, N.Y.

[73] Assignee: Xerox Corporation, Stamford, Conn.

[21] Appl. No.: 597,154

[22] Filed: Oct. 15, 1990

[51] Int. Cl.[5] ..... B65H 3/34

[52] U.S. Cl. ..... 271/104; 271/98; 271/167

[58] Field of Search ..... 271/12, 98, 104, 121, 271/123, 167

[56] References Cited

U.S. PATENT DOCUMENTS

| | | | |
|---|---|---|---|
| 1,258,026 | 3/1918 | Lindbladh | 271/123 |
| 1,675,525 | 7/1928 | Aldrich | 271/104 |
| 3,218,062 | 11/1965 | Wickland | 271/98 |
| 3,625,508 | 12/1971 | Shiragai . | |
| 3,738,645 | 6/1973 | Gray et al. . | |
| 3,882,744 | 5/1975 | McCarroll . | |
| 3,938,800 | 2/1976 | Wirz | 271/98 |
| 3,979,115 | 9/1976 | Bruckner et al. . | |
| 4,089,518 | 5/1978 | Vollrath | 271/167 |
| 4,324,395 | 4/1982 | Silverberg . | |
| 4,526,358 | 7/1985 | Ura et al. . | |
| 4,635,921 | 1/1987 | Thomas | 271/98 |
| 4,887,805 | 12/1989 | Herbert et al. | 271/98 |

FOREIGN PATENT DOCUMENTS

| | | | |
|---|---|---|---|
| 559568 | 9/1932 | Fed. Rep. of Germany | 271/104 |
| 67343 | 4/1985 | Japan | 271/104 |
| 249835 | 10/1987 | Japan | 271/98 |

*Primary Examiner*—Robert P. Olszewski
*Assistant Examiner*—Steven M. Reiss
*Attorney, Agent, or Firm*—Finnegan, Henderson, Farabow, Garrett & Dunner

[57] ABSTRACT

An apparatus for individually feeding sheets from a stack of sheets, comprises a tray for supporting a stack of sheets to be fed therefrom. A sheet feeder is provided for individually capturing a top sheet from the stack and for conveying the top sheet out of the tray. A solenoid-activated sheet hold down device is provided which includes a portion being cyclically movable toward and away from the stack for exerting a force on a next top sheet beneath the top sheet to prevent the next top sheet from being forwarded out of the tray while the top sheet is being forwarded.

20 Claims, 5 Drawing Sheets

APPARATUS FOR METHOD FOR HIGH SPEED SHEET FEEDING

BACKGROUND OF THE INVENTION

1. Field of the Invention

The invention relates to an apparatus and method for feeding sheets from a stack. More specifically, the invention relates to a sheet feeder for printers and copy machines capable of feeding sheets at rates in excess of 1200 pages per minute.

2. Description of the Related Art

In related art devices such as copy machines, sheets of copy paper are fed off of a stack using a drive mechanism that starts and stops to feed each sheet. The drive mechanism generally includes a vacuum plenum for drawing a sheet against a feed belt that starts and stops between each successive sheet feeding. While such related art devices have proven successful and reliable, since the feed belt must start and stop between each successive sheet, the sheet feeding speed is limited. Sheet feeding rates in excess of 400 pages per minute (ppm) are uncommon in prior art devices. However, the current trend in the printing arts is towards copiers and printers that reliably operate at high speeds, such as 600 ppm and faster.

In addition, in related art devices, the motor that, drives the feed belt must constantly start and stop. Not only is this inefficient, but it also causes undue wear on the sheet feeding motor.

Further, many prior art devices include complex and costly registration hardware for timing and aligning the copy paper sheet with the position of a tone image on the photoreceptor at a transfer location.

An object to the invention is to provide a sheet feeding apparatus capable of reliably feeding sheets at high rates of speed.

A further object of the present invention is to provide a sheet feeding device that minimizes wear on the sheet feeding motor.

An additional object of the present invention is to provide a sheet feeding device that eliminates the need for costly and complex registration hardward.

Additional objects and advantages of the invention will be set forth in part in the description which follows, and in part will be obvious from the description or may be learned by practice of the invention. The objects and advantages of the invention will be realized and attained by means of the elements and combinations particularly pointed out in the appended claims.

SUMMARY OF THE INVENTION

To achieve the objects and in accordance with the purposes of the invention, as embodied and broadly described herein, the invention comprises tray means for supporting a stack of sheets to be fed therefrom , feed means for individually capturing a top sheet from the stack and conveying the top sheet out of said tray means, and hold down means including a portion being cyclically movable toward and away from the stack for exerting a force on a next top sheet beneath said top sheet to prevent the next top sheet from being forwarded out of the tray while the top sheet is being forwarded out of the tray.

The invention also comprises a method including the steps of capturing a top sheet from the stack, conveying the top sheet a predetermined distance out of the tray so that there exists a space between that railing edge of the top sheet and a corresponding trailing edge of a next top sheet immediately beneath the top sheet, exerting a downward force from above the space on the sheet beneath the top sheet, conveying the trailing edge of the top sheet out of the tray, and releasing the downward force after the trailing edge of the top sheet is out of the tray.

It is to be understood that both the foregoing general description and the following detailed description are exemplary and explanatory only and not restrictive of the invention, as claimed.

The accompanying drawings, which are incorporated in and constitute a part of the specification, illustrate one embodiment of the invention and together with the description, serve to explained the principles of the invention.

DESCRIPTION OF THE PREFERRED EMBODIMENT

Reference will now be made in detail to the present preferred embodiment of the invention, an example of which is illustrated in the accompanying drawings.

Figure 1:
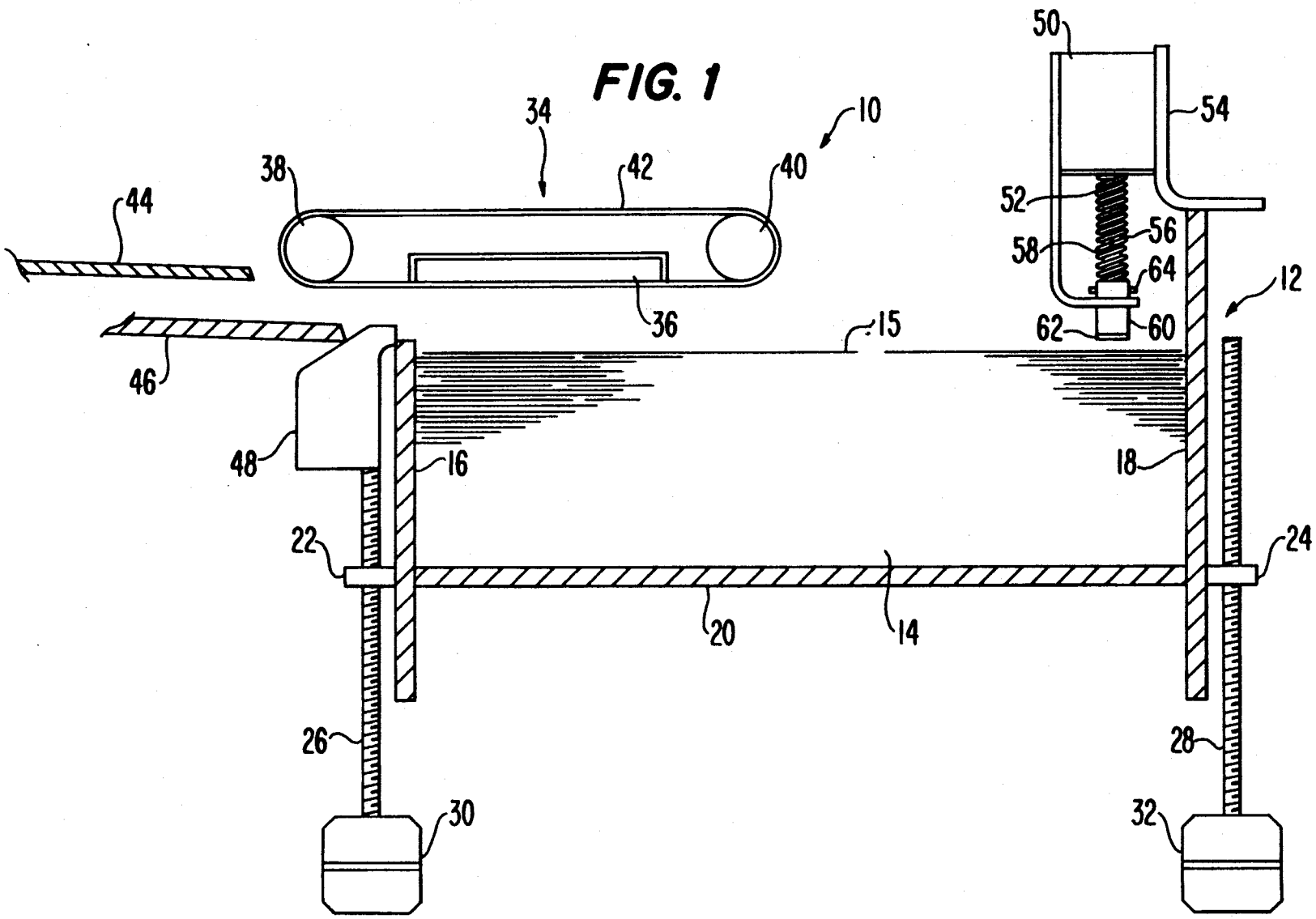
FIG. 1 is a partial section of a sheet feeding apparatus in accordance with the present invention.

In accordance with the present invention, there is provided an apparatus for individually feeding sheets from a stack of sheets, including tray means for supporting a stack of sheets to be fed therefrom. As embodied herein, and as depicted in FIG. 1, sheet feeding device 10 includes tray 12 for supporting a stack of sheets 14. Tray 12 includes vertical walls 16 and 18 that may be movable to accommodate sheets of varying lengths. Tray 12 may also include a movable base such as bottom plate 20. Extensions 22 and 24 of bottom plate 20 extend through slots (not shown) in walls 16 and 18. Extensions 22 and 24 threadingly engage lead screws 26 and 28, that are respectively connected to motors 30 and 32. Rotation of motors 30 and 32 in a first direction causes plate 20 to rise while rotation of motors 30 and 32 in a second direction lowers plate 20.

Figure 8:
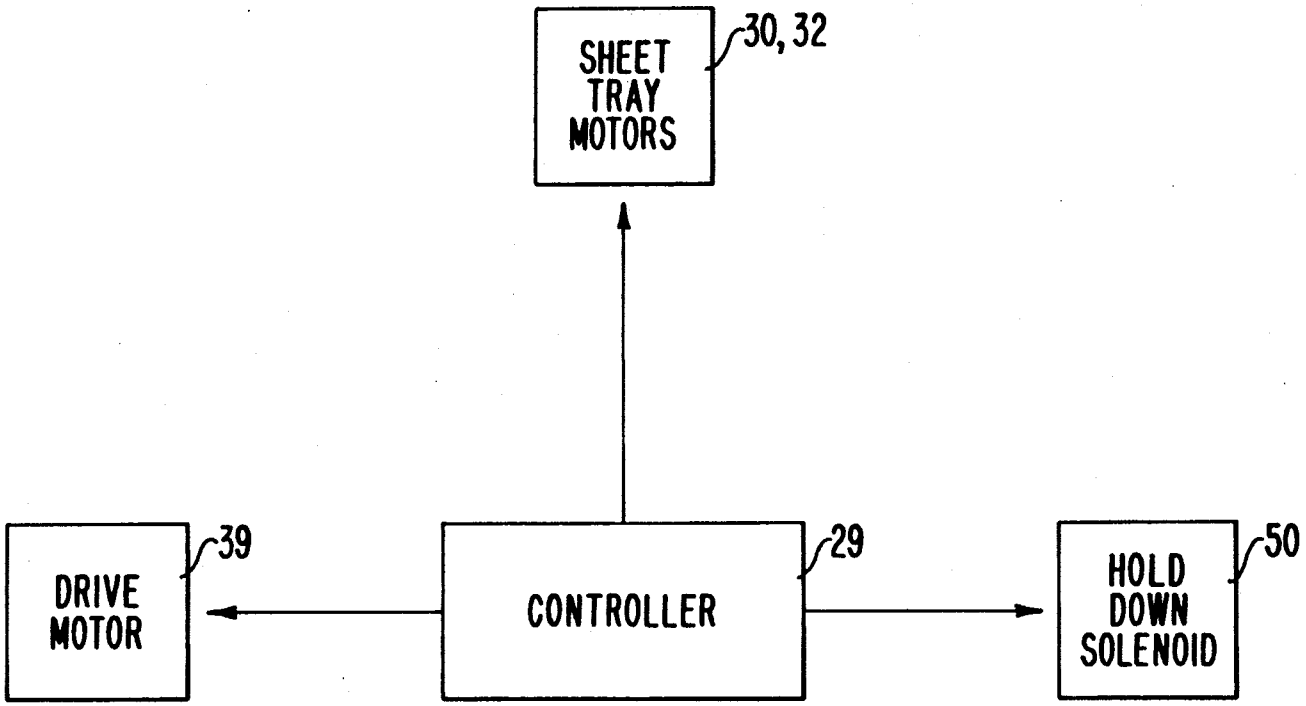
FIG. 8 schematically depicts the interaction of the controller with other components of the present invention.

A sensor (not shown) detects when the top edge 15 of stack 14 falls below a predetermined level. The sensor sends a signal to controller 29 (FIG. 8) which causes motors 30 and 32 to raise plate 20 and stack 14 a preselected amount.

Also in accordance with the present invention, there is provided feed means for individually capturing a top sheet from the stack and conveying the top sheet out of the tray means. As embodied herein, feed means may include a standard sheet feeder such as vacuum corrugation feeder 34 positioned above tray 12 with virtually no obstructions therebetween. Vacuum corrugation feeder 34 includes vacuum plenum 36 disposed between drive rollers 38 and 40. Feed belt 42, which includes perforations disposed therein, is entrained about drive rollers 38 and 40. In the alternative, multiple feed belts may be entrained about drive rollers 38 and 40. Vacuum plenum 36 is connected to a vacuum motor (not shown). Activation of the vacuum motor causes lower pressure within vacuum plenum 36, thereby drawing air through the perforations in belt 42 and into plenum 36. This flow of air causes top sheet 15 to be drawn against feed belt 42. When drive rollers 38 and 40 are rotated, feed belt 42 conveys a sheet captured against the feed belt out of tray 12 and into a paper path between baffles 44 and 46.

In order to prevent a sheet (the next top sheet) beneath top sheet 15 from adhering to top sheet 15, a blower 48 may be disposed adjacent wall 16 of tray 12. Blower 48 directs a stream of air between a top sheet captured by vacuum plenum 36 and the next top sheet beneath the top sheet. This stream of air is generally sufficient to separate sheets that may be held together by static electricity.

In accordance with the present invention, there is also provided hold down means including a portion being cyclically movable toward and away from the stack for exerting a force on the next top sheet beneath the top sheet to prevent the next top sheet from being forwarded out of the tray means while the top sheet is being forwarded out of the tray means. As embodied herein, hold down means includes solenoid 50 and a movable spring loaded plunger 52 extending therefrom. Solenoid 50 is mounted above the trail end of stack 14 on L-bracket 54 that is supported on wall 18 of tray 12. Spring loaded plunger 52 includes spring 58 disposed about shaft 56. Cap 60 having a elastomeric tip 62 is mounted on the distal end of shaft 56 via pin 64 that extends through shaft 56 and cap 60.

Figure 4:
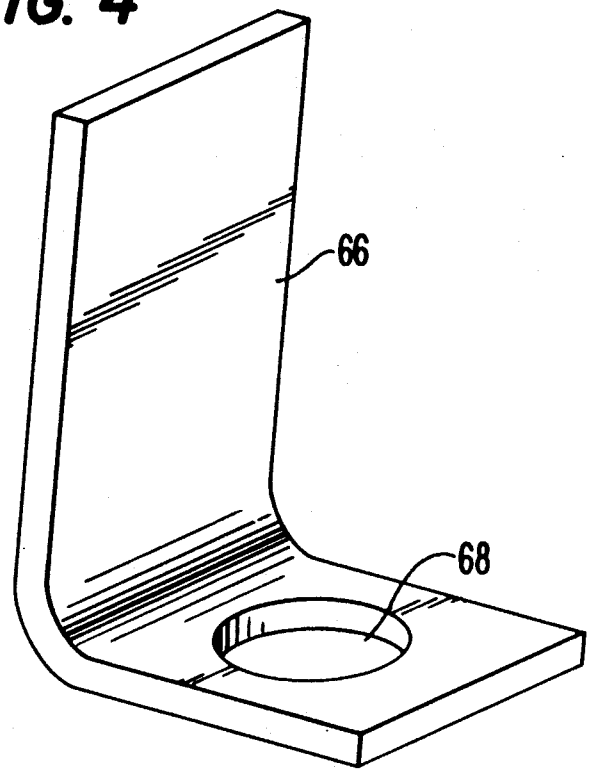
FIG. 4 is a perspective view of an L-shaped support bracket shown in FIG. 1.

L-shaped support bracket 66, a perspective view of which is shown in FIG. 4, is mounted on solenoid 50 to protect shaft 56 of spring loaded plunger 52 from being bent and to prevent shaft 56 from falling out of solenoid 50. Support bracket 66 includes opening 68 for receiving cap 60. Opening 68 is sized to allow cap to move upward when solenoid 50 is actuated and to prevent shaft 56 from being translated in a plane perpendicular to its central axis.

When solenoid 50 is in a non-actuated state, spring 58 acting between solenoid 50 and cap 60 urges elastomeric tip 62 against the top 15 of stack 14. When solenoid 50 is actuated, elastomeric tip 62 is drawn away from the top 15 of stack 14.

Figure 2:
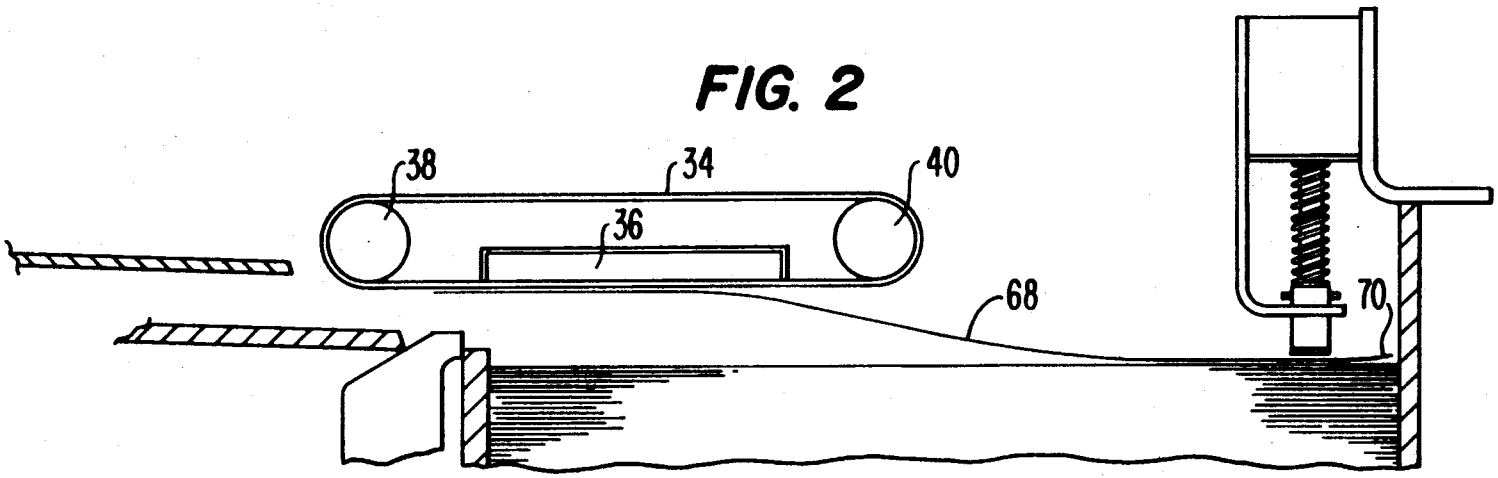
FIG. 2 illustrates a fist step in the feeding processes of the present invention when a solenoid hold-down device is actuated.
Figure 3:
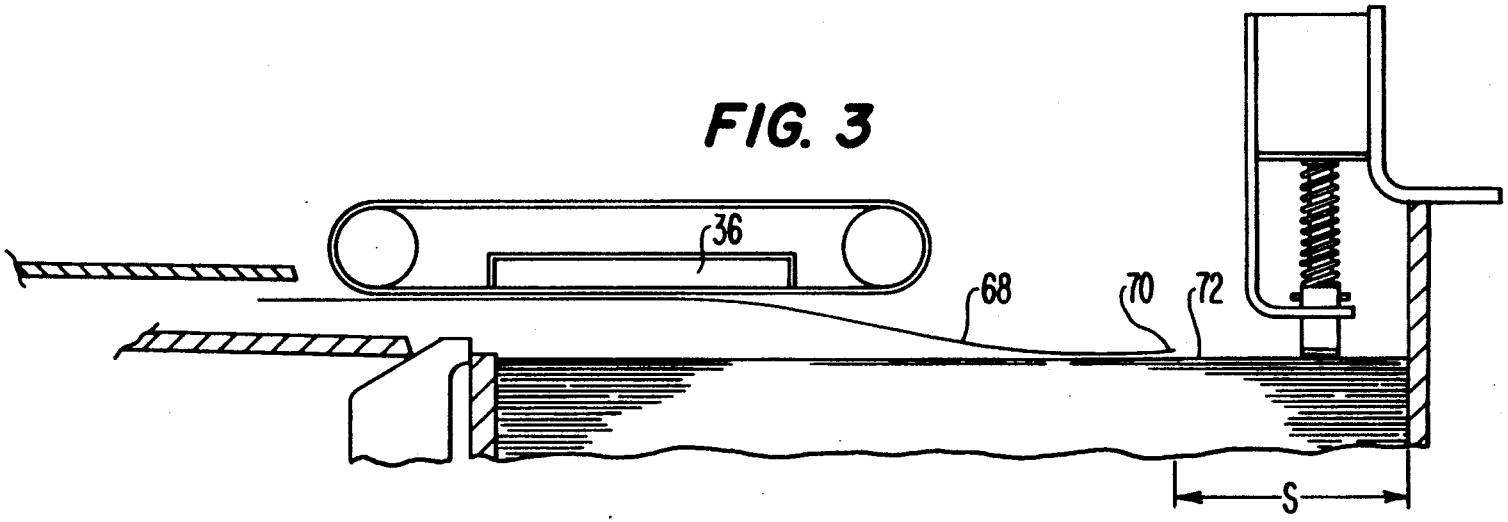
FIG. 3 illustrates a second step in the feeding process of the present invention when a solenoid hold-down device is not activated.
Figure 5:
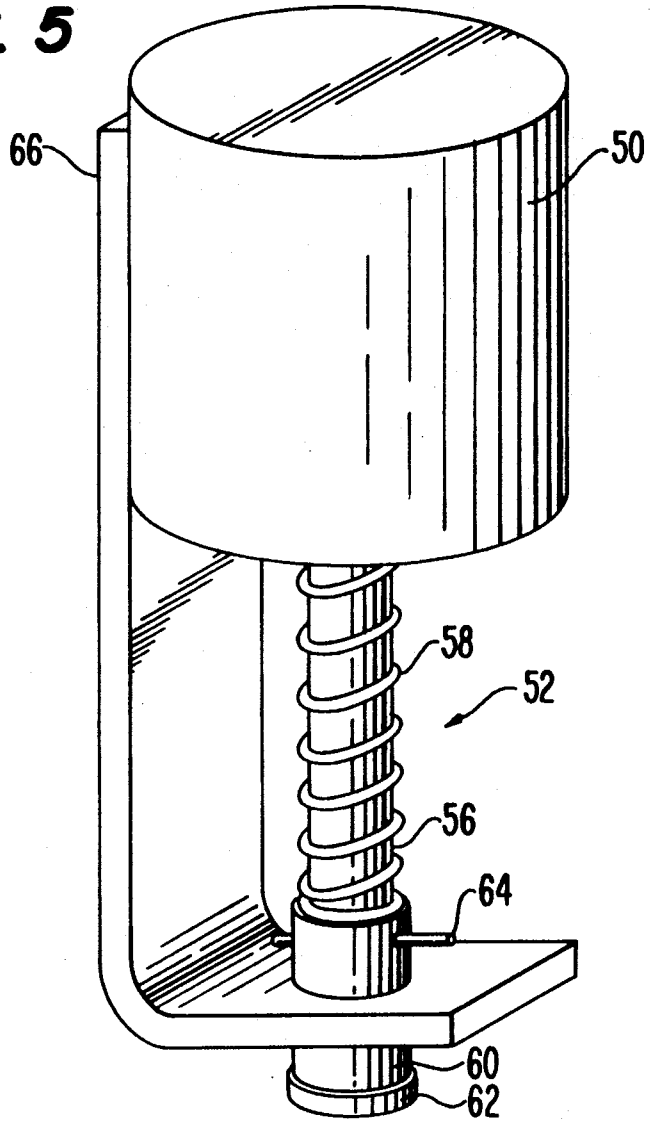
FIG. 5 is a perspective view of the spring loaded solenoid hold-down device illustrated in FIG. 1.

Operation of the invention will now be described with reference to FIGS. 2 and 3. Initially, drive rollers 38 and 40 are rotated at a predetermined velocity in order to drive feed belt 34. Controller 29 maintains a virtually constant velocity of feed belt 34 through successive sheet feedings which constitutes an operation cycle. Thus, the feed belt does not start and stop with the feeding of each successive sheet.

A vacuum force supplied through vacuum plenum 36 draws top sheet 68 against feed belt 34. Initially, as shown in FIG. 2, solenoid 50 is actuated to release the hold-down force on top sheet 68 and thereby allow it to be forwarded out of tray 12. As soon as a predetermined space S exists between the trailing edge of the top sheet and a corresponding trailing edge of the sheet beneath, solenoid 50 is deactivated by controller 29 to thereby exert a hold-down force caused by spring 58 urging elastomeric tip 62 against the next top sheet 72 beneath top sheet 68. While space S may vary depending on design requirements, it is critical, according to the present preferred embodiment of the invention, that the hold-down force on the next top sheet 72 beneath top sheet 68 be exerted before the trailing edge 70 of top sheet 68 reaches vacuum plenum 36. Otherwise, simultaneous multiple sheet feeding may occur.

Controller 29 (shown in FIG. 8) coordinates the velocity of drive motor 39 that drives rollers 38, 40, with the operation of solenoid 50. During normal operation, vacuum feed belt 34 runs continuously and sheets are fed each time elastomeric tip 62 is lifted by solenoid 50. Thus, since the time that it takes for the vacuum plenum to acquire the top sheet is very short, the maximum feed rate of the system is limited by the length of time that it takes for the hold down device to be lifted and dropped. Theoretically, the solenoid can be actuated by controller 29 at a maximum rate of 3200 actuations per minute.

Figure 6:
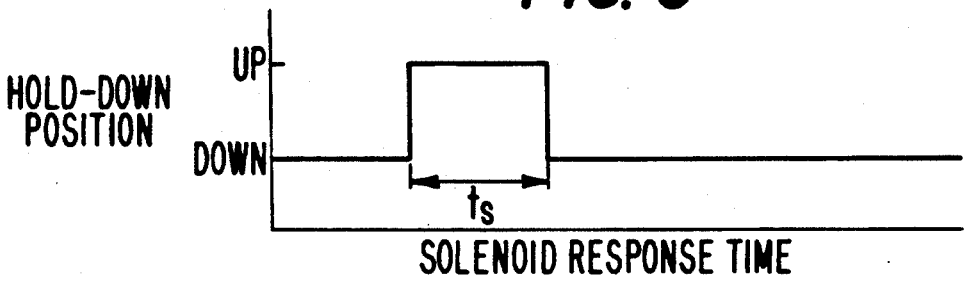
FIG. 6 is a graph depicting response time of the solenoid depicted in FIG. 5.

Assuming that the hold down device is lifted from the stack instantaneously and that it can also be dropped instantaneously, the hold down time ($t_s$) may be depicted graphically as shown in FIG. 6.

To avoid simultaneously feeding multiple sheets, the hold down mechanism should be dropped before the trail edge of the sheet being fed exposes the vacuum ports in feed belt 34 to the sheet beneath the sheet being fed. This requirement also limits the maximum speed ($V_{pmax}$) at which the feed belts may run as described below.

$$V_{pmax} = \frac{(d_p - d_v)}{t_s}$$

Figure 7:
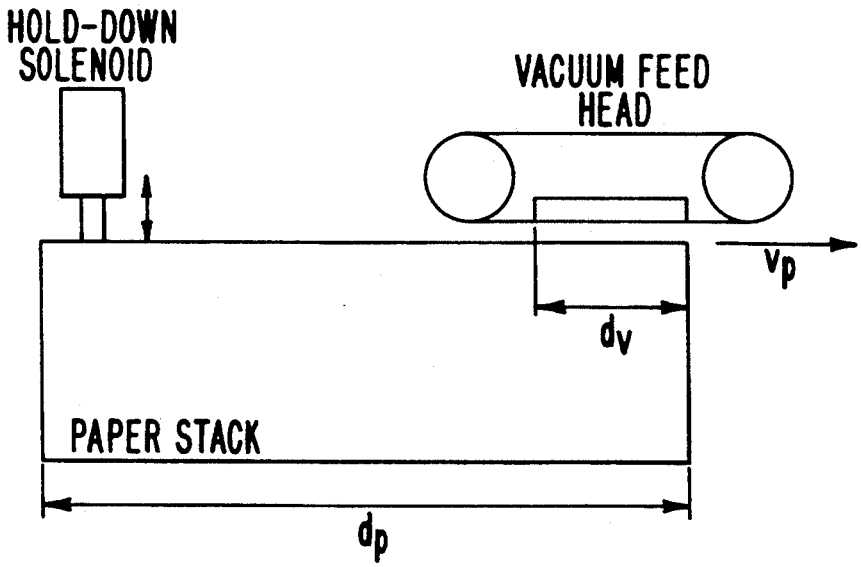
FIG. 7 schematically depicts the sheet feeding apparatus of FIG. 1 and includes various critical dimensions.

As depicted in FIG. 7, $d_p$ represents the length of the paper stack, and $d_v$ represents the distance between the leading edge of the stack and the trailing edge of the vacuum plenum.

The maximum copy sheet feed rate ($R_{cpm}$) is then limited by the feed belt speed ($V_{pmax}$), the paper length ($d_p$) and the required copy gap ($d_{cg}$), i.e., the required gap between the trailing edge of a sheet being fed and the leading edge of the subsequent sheet being fed. These values are related as shown below.

$$R_{cpm} = 60 \frac{(V_{pmax})}{d_p + d_{cg}}$$

and therefore:

$$R_{cpm} = 60 \frac{(1)}{ts} \quad \frac{(d_p - d_v)}{(d_p + d_{cg})}$$

From the above equation, it can be observed that the maximum copy sheet feed rate is inversely proportional to the solenoid response time. In addition, the maximum copy sheet feed rate increases as $d_v$ and $d_g$ decrease and as $d_p$ increases.

Solenoid 50 should be capable of being operated at frequency of 0–3200 actuations per minute, or greater, preferably in the range of 100–1200 actuations per minute. Obviously, these rates are not restrictive of the invention as claimed and may be increased or decreased depending on the hardware used and copy rate requirements.

With the present invention, it has been found that the solenoid performs a timing function similar to that of conventional registration hardware. Therefore, the present invention may eliminate costly and complex registration hardware, which is conventionally used to ensure that copy sheets arrive at a predetermined transfer location at a specific time. This conventional registration hardware is typically necessary because of difficulty in precisely controlling the time when a given sheet leaves the tray. Therefore, timing is conventionally adjusted with registration hardware as a sheet travels along a path from the tray to a transfer location. In contrast, since the release time of a given sheet from the paper tray can be precisely controlled with the solenoid hold down device of the present invention as depicted in the graph of FIG. 6, a controller can send a release signal to the solenoid based upon a timing signal received from a downstream sheet processing station. In other words, by exerting, through a solenoid, a force on the next top sheet beneath the top sheet in the tray, the space S (FIG. 3) between the trailing edge of the top sheet and the leading edge of the sheet beneath may be precisely controlled. This can eliminate the need to make timing corrections as the sheet travels to a downstream processing station, such as an image transfer location.

It will be apparent to those skilled in the art that various modifications and variations can be made to the present invention without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for individually feeding sheets from a stack of sheets during an operation cycle, the apparatus comprising:

tray means for supporting a stack of sheets to be fed therefrom;

feed means for individually capturing atop sheet from the stack and conveying said top sheet out of said tray means, said feed means being operable at a substantially constant velocity during the operation cycle;

a solenoid activated hold down device including a portion being cyclically movable toward and away from the stack for exerting a force on a next top sheet beneath said top sheet to prevent said next top sheet from being forwarded out of said tray means while said top sheet is being forwarded out of said tray means; and control means connected to the solenoid activated hold down device for sending signals thereto to control a sheet release rate, the control means being capable of sending signals corresponding to varying sheet release rates.

2. An apparatus according to claim 1, wherein said cyclically movable portion of said hold down device is disposed to contact a trailing edge of said next top sheet.

3. An apparatus according to claim 1, wherein said cyclically movable portion of said hold down device includes an elastomeric tip for contacting said next top sheet.

4. An apparatus according to claim 1, further including actuation means for actuating said solenoid activated hold down device at a predetermined frequency.

5. An apparatus according to claim 4, wherein said frequency is in the range of 0 and 3200 actuations per minute.

6. An apparatus according to claim 1, wherein said feed means includes a vacuum plenum.

7. An apparatus according to claim 6, wherein said feed means includes a feed belt disposed between said vacuum plenum and said tray means, said feed belt having ports disposed therein, a portion of said ports being initially covered by a captured sheet, said hold down device for releasing said force on said next top sheet when said captured sheet exposes said portion of said ports initially covered by said captured sheet.

8. An apparatus according to claim 1, wherein said feed means includes a conveyor, the apparatus further comprising means for maintaining a substantially constant velocity of said conveyor between sequential capture and feeding of individual sheets.

9. An apparatus according to claim 1, wherein an area between said tray means and said feed means is virtually unobstructed.

10. An apparatus for individually feeding sheets from a stack of sheets, the apparatus comprising:

tray means for supporting a stack of sheets to be fed therefrom;

a vacuum plenum;

a feed belt disposed between said vacuum plenum and said tray means, said feed belt having ports disposed therein and covering a first portion of said tray means and exposing a second portion of said tray means, said feed belt cooperating with said vacuum plenum to individually capture a top sheet from the stack and to convey the top sheet out of said tray means;

hold down device having a portion for exerting a force on a next top sheet beneath said top sheet, said portion of said hold down device being disposed above said second portion of said tray; and means for activating said hold down device at a predetermined frequency, said activating means for releasing said force on said next top sheet when the captured sheet exposes a portion of said ports initially covered by the captured sheet.

11. An apparatus according to claim 10, wherein said portion of said hold down means is disposed to contact a trailing edge of said next top sheet.

12. An apparatus according to claim 10, wherein said portion of said hold down device includes an elastomeric tip for contacting said next top sheet.

13. An apparatus according to claim 10, wherein said hold down device includes a solenoid activated mechanism.

14. An apparatus according to claim 13, further including means for actuating said solenoid hold down device at a predetermined frequency.

15. An apparatus according to claim 14, wherein said frequency is in the range of 0 and 3200 actuations per minute.

16. A method for feeding sheets from a stack disposed in a tray, the method comprising the steps of:

capturing a top sheet from the stack;

conveying said top sheet a predetermined distance out of the tray so that there exists a space between the trailing edge of the top sheet and corresponding trailing edge of a next top sheet immediately beneath the top sheet;

exerting, with a solenoid actuated device, a downward force at a predetermined frequency, from above said space, to control the size of said space, said force being exerted on said next top sheet beneath the top sheet, and said size of said space being dependent upon downstream conditions;

conveying the trailing edge of the top sheet out of the tray; and releasing the downward force after the trailing edge of the top sheet is out of the tray,

17. The method of claim 16, further including the step of maintaining a substantially constant feed belt velocity through the sequential feeding of multiple sheets.

18. The method of claim 16, wherein in the step of releasing the downward force, the force is released only after a predetermined space exists between the trailing edge of the captured sheet and a leading edge of the sheet immediately beneath the top sheet.

19. A method for feeding sheets from a stack disposed in a tray, the method comprising the steps of:

drawing a top sheet against a feed belt having vacuum ports disposed therein;

conveying said top sheet a predetermined distance out of the tray so that there exists a space between the trailing edge of the top sheet and a corresponding trailing edge of a next top sheet immediately beneath the top sheet;

exerting, before vacuum ports in the belt are exposed to the next top sheet, a downward force from above said space on said next top sheet beneath the top sheet;

conveying the trailing edge of the top sheet out of the tray; and releasing the downward force after the trailing edge of the top sheet is out of the tray.

20. An apparatus for individually feeding sheets from a stack of sheets during an operation cycle, the apparatus comprising:

tray means for supporting a stack of sheets to be fed therefrom;

feed means for individually capturing a top sheet from the stack and conveying said top sheet out of said tray means, said feed means being operable at a substantially constant velocity during the operation cycle;

a hold down device including a portion being cyclically movable toward and away from the stack for exerting a force on a next top sheet beneath said top sheet to prevent said next top sheet from being forwarded out of said tray means while said top sheet is being forwarded out of said tray means; and control means connected to the hold down device for sending signals thereto to control a sheet release rate, the control means being capable of sending signals corresponding to varying sheet release rates.

* * * * *